US006607038B2

(12) United States Patent
Ebersole, Jr. et al.

(10) Patent No.: US 6,607,038 B2
(45) Date of Patent: Aug. 19, 2003

(54) INSTRUMENTED FIREFIGHTER'S NOZZLE AND METHOD

(75) Inventors: John Franklin Ebersole, Jr., Bedford, NH (US); Todd Joseph Furlong, Goffstown, NH (US)

(73) Assignee: Information Decision Technologies, LLC, Bedford, NH (US)

( * ) Notice: Subject to any disclaimer, the term of this patent is extended or adjusted under 35 U.S.C. 154(b) by 0 days.

(21) Appl. No.: 09/826,993

(22) Filed: Apr. 5, 2001

(65) Prior Publication Data

US 2002/0008153 A1 Jan. 24, 2002

Related U.S. Application Data

(63) Continuation-in-part of application No. 09/525,983, filed on Mar. 15, 2000.

(60) Provisional application No. 60/195,503, filed on Apr. 6, 2000.

(51) Int. Cl.[7] ..... A62C 35/00; A62C 2/00; A62C 3/00; A62C 25/00; A62C 37/10

(52) U.S. Cl. ..... 169/14; 169/43; 169/45; 169/46; 169/47; 169/52; 169/60

(58) Field of Search ..... 169/14, 43, 46, 169/60, 47, 19, 23, 30, 45, 52, 25, 70, 24; 239/67, 69, 71, 302, 525, 531, 569, 75, 587; 434/226, 219, 365, 21, 22, 36, 41, 43

(56) References Cited

U.S. PATENT DOCUMENTS 3,768,567 A * 10/1973 Weise ..... 169/26
3,776,313 A * 12/1973 DePalma ..... 169/19
3,974,879 A * 8/1976 Nelson, Jr. et al. ..... 169/43
4,830,116 A * 5/1989 Walden et al. ..... 169/65
4,909,329 A * 3/1990 Yoshida et al. ..... 169/61
4,949,794 A * 8/1990 Petit et al. ..... 169/52
4,983,124 A * 1/1991 Ernst et al. ..... 434/226
5,316,484 A * 5/1994 Layton et al. ..... 434/226
5,374,191 A * 12/1994 Herman et al. ..... 434/226
5,458,201 A * 10/1995 Brim ..... 169/26
5,460,228 A * 10/1995 Butler ..... 169/30
5,548,276 A * 8/1996 Thomas ..... 340/578
5,846,085 A * 12/1998 Witt, III ..... 434/226
6,279,664 B1 * 8/2001 Yanovsky et al. ..... 169/75

* cited by examiner

*Primary Examiner*—Davis Hwu
(74) *Attorney, Agent, or Firm*—Brian M. Dingman, Esq.; Mirick, O'Connell, DeMallie & Lougee, LLP

(57) ABSTRACT

Method and apparatus are presented for instrumentation of a firefighter's vari-nozzle for motion tracking and measurement of pattern selector and bail handle positions. In the embodiment presented here, brackets and associated hardware attach (1) a position tracking device to the nozzle to measure its 6-DOF (Degrees of Freedom) position and orientation, and (2) potentiometers to measure the angular positions of the two main, moving components (the bail handle and the pattern selector) of the nozzle. The mounts are attached to the brass nozzle with holes drilled into the main body of the nozzle.

One application of this instrumentation is control of an augmented reality or virtual reality water stream, or other extinguishing agent. The electronic signals from potentiometers in the instrumentation permit a computer to calculate and display graphical representations of water flow from the nozzle for virtual reality and augmented reality applications. This virtual flow is responsive to the motions of the user with the nozzle, including operation of the bail handle (on/off of water flow) and the nozzle pattern selector (straight stream, narrow angle fog, and wide angle fog). The position tracking information is used to align a computer graphical representation of a water stream with the real nozzle.

16 Claims, 19 Drawing Sheets

Idea for internal rotary potentiometer
Crosscut View

Idea for highly concealed potentiometer
Back View

Idea for potentiometer that doesn't puncture nozzle
Back View

INSTRUMENTED FIREFIGHTER'S NOZZLE AND METHOD

CROSS REFERENCE TO RELATED APPLICATIONS

This application claims priority of Provisional patent application 60/195,503 filed Apr. 6, 2000, and is a Continuation in Part of "Augmented Reality-Based Firefighter Training System and Method" Ser. No. 09/525,983 filed Mar. 15, 2000.

GOVERNMENT RIGHTS

This invention was made with Government support under Contract Number N61339-98-C-0036 awarded by the Department of the Navy. The Government has certain rights in the invention.

FIELD OF THE INVENTION

This invention relates to real-time data acquisition for purposes of measuring the operation of a fire hose nozzle. Mechanical and electronic components have been designed and attached to a nozzle for purposes of instrumentation. The field in which the invention is currently used is that of virtual reality and augmented reality. The invention is used as an input device to control a computer-generated water stream and align that stream with the actual nozzle in a manner consistent with its operation.

COPYRIGHT INFORMATION

A portion of the disclosure of this patent document contains material that is subject to copyright protection. The copyright owner has no objection to the facsimile reproduction by anyone of the patent document or the patent disclosure as it appears in the Patent and Trademark Office records but otherwise reserves all copyright works whatsoever.

BACKGROUND OF THE INVENTION

Information establishing the real-time position and orientation of a nozzle (e.g., a firefighter's nozzle) is useful, as is information establishing the settings of the nozzle bail handle and pattern selector. With this information, a computer will know how the nozzle is being operated, and the data may then be collected or applied to a real-time simulation. One application is the need to accurately display a graphical representation of a water stream, or other extinguishing agent, that is responsive to the actions of a user operating the nozzle, such as for augmented reality or virtual reality.

SUMMARY OF THE INVENTION

The purpose of the invention is to enable control of a computer-generated graphical spray with a real vari-nozzle for firefighter training. Key aspects of the invention include (1) an instrumented bail handle, which controls the flow of water or extinguishing agent through a nozzle, and (2) an instrumented pattern selector, which controls the angle of the fog spray from a nozzle. Another aspect (3) of the invention is a mount that allows a motion tracker to have line of sight with the ceiling and be unobtrusive to a user of the instrumented nozzle.

The invention provides sufficient accuracy on a real-time basis so that a computer can generate realistic and responsive graphics depicting water flow through the nozzle. This flow can be a wide fog pattern, a straight stream pattern or anything in between, typical of streams used by firefighters. Additionally, the bail handle measurements provided by the instrumentation permit a computer to operate continuously from the off position to steady flow. The graphics generated by a computer can be displayed to a user of the instrumented nozzle by means of virtual reality, augmented reality, or other displays.

DETAILED DESCRIPTION OF THE PREFERRED EMBODIMENTS OF THE INVENTION

Most of the components that were designed and machined for this invention were made from black Delrin™ (a hard plastic made by DUPONT) (du Pont de Nemours and Company, 1007 Market Street, Wilmington, Del. 19898, U.S.A) or black Nylon 66™. The specific invention is designed to attach to a standard ELKHART (Elkhart Brass Mfg. Co. Inc., P.O. Box 1127, 1302 W. Beardsley Ave., Elkhart, Ill. 46515, U.S.A) 1.5-inch brass nozzle (Model SFL-GN-95) used for fire fighting.

Mount for the InterSense Tracking Equipment

One component of the invention is a mount for a piece of motion tracking equipment required to determine the position and orientation of the nozzle as a whole in real time. The motion tracking products used in the preferred embodiment of this invention require line of sight to ceiling-mounted grids, so the mount had to hold the motion tracking equipment to the side of and above the nozzle for best line of sight.

Figure 1:
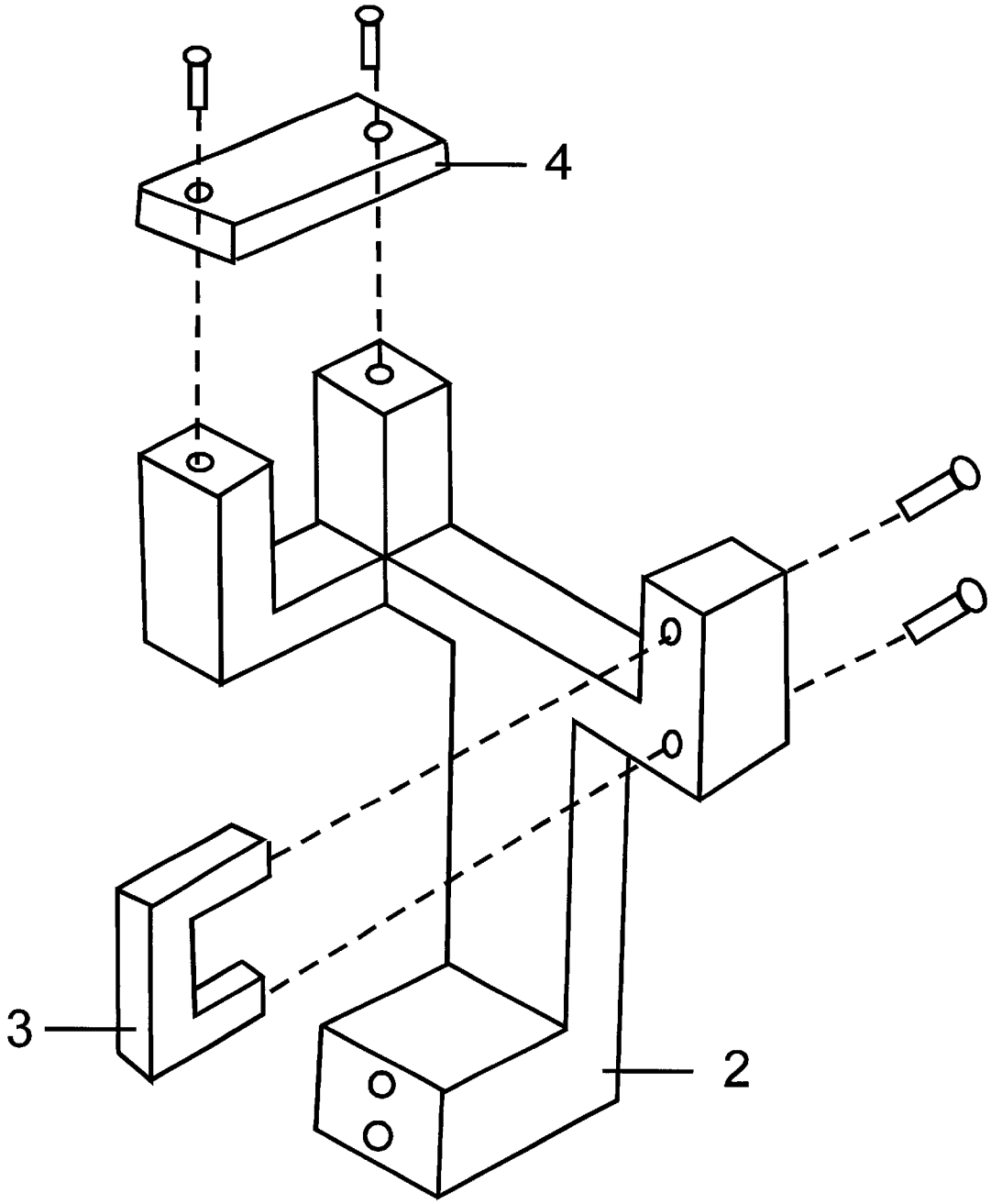
FIG. 1 is a sketch of a design for the vertical mount that holds an INTERSENSE IS-900™ "Stylus" tracking station.
Figure 2:
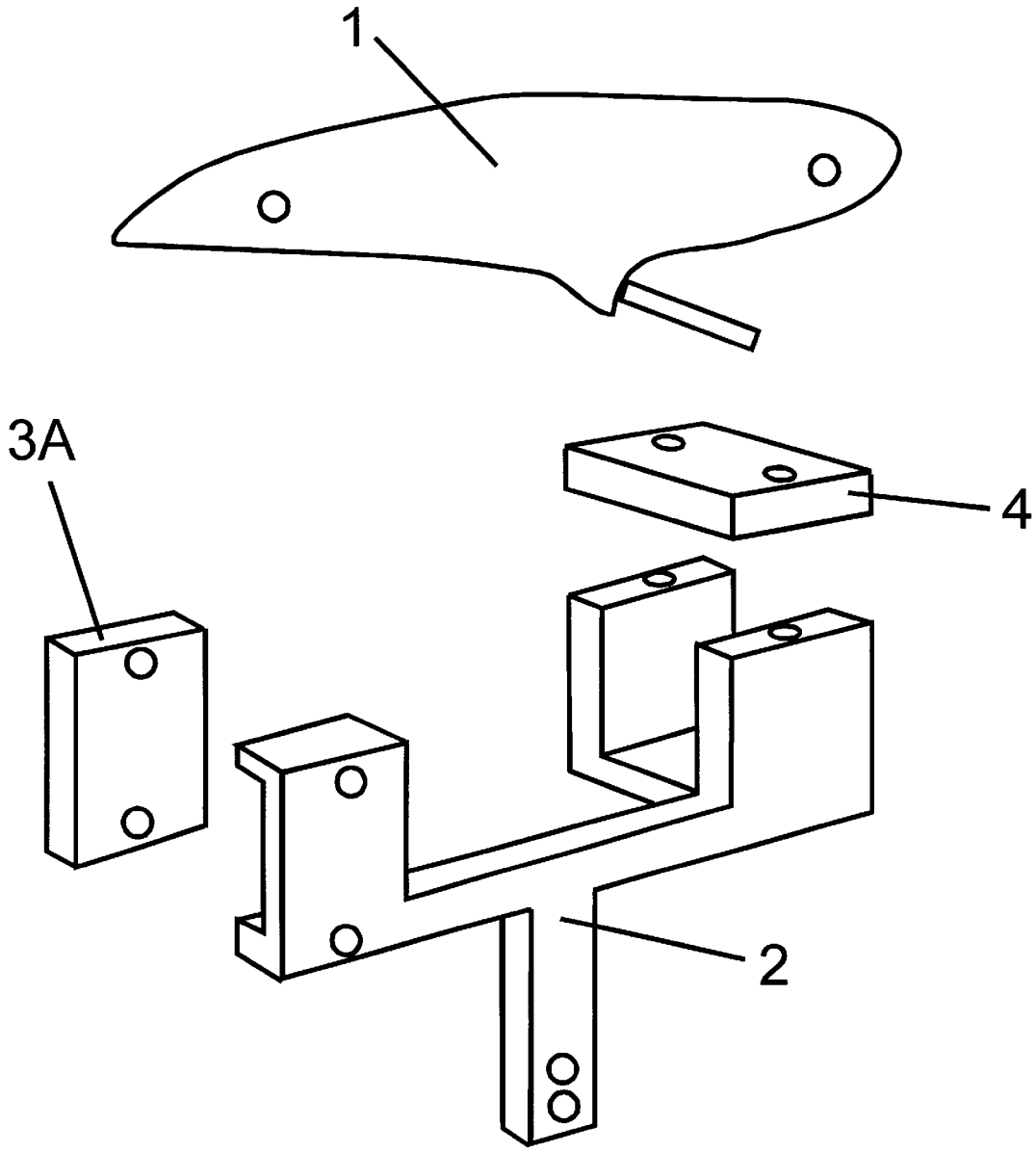
FIG. 2 is an assembly drawing of the preferred vertical bracket of an IS-900™ vertical mount.

FIG. 1 is an exploded assembly drawing showing how a side clamp 3 designed to hold an INTERSENSE (InterSense, Inc., 73 Second Avenue, Burlington, Mass. 01803, U.S.A) IS-900™ stylus 1 from the side and a top clamp 4 designed to hold the stylus 1 from the top fit together with the vertical portion of the mount 2. FIG. 2 shows a sketch of the vertical portion of the mount 2 designed to hold the stylus 1 with an alternative method of attaching the stylus to the bracket via the side clamp 3*a* and the identical top clamp 4. The mounts we created to hold the INTERSENSE IS-900™ stylus on the side and from the top allow the stylus to be held in place firmly without having to require undue amounts of tolerance in the dimensions of the bracket components. When assembled, there are gaps between the side and top clamps which allow the screws to provide a clamping force onto the IS-900™ stylus.

Figure 3:
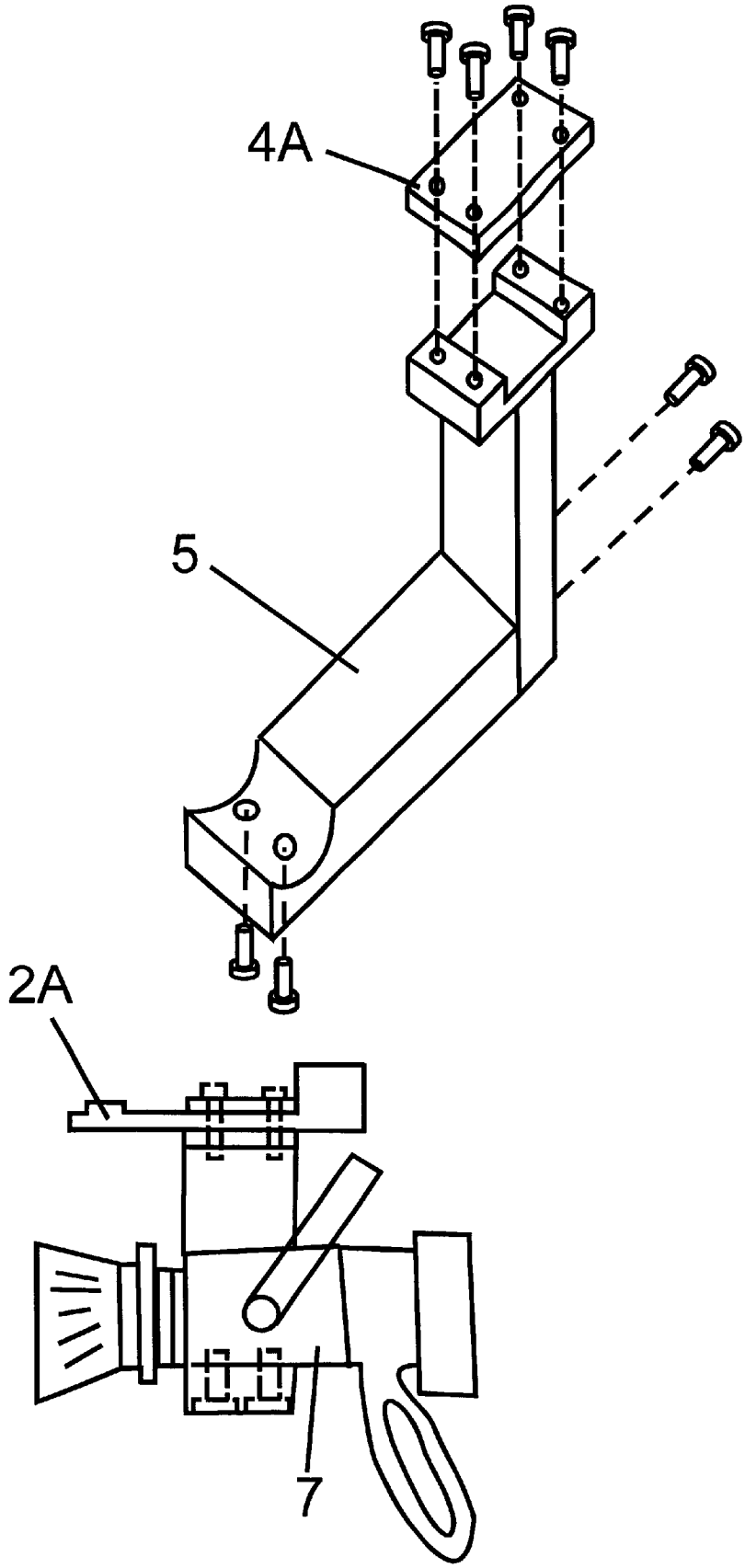
FIG. 3 is an assembly drawing and for a mount that holds an INTERSENSE IS-600™ tracking station.

In FIG. 3, the curved cutout in the main horizontal bracket 5 matches the external radius of the nozzle. Drilling a hole (not shown) along the length of horizontal bracket 5 can produce an easy-to-wire conduit which allows wires to be contained completely within the bracket and nozzle barrel and hidden from external view. The nozzle may be drilled and tapped to match holes made in the bracket.

Figure 4:
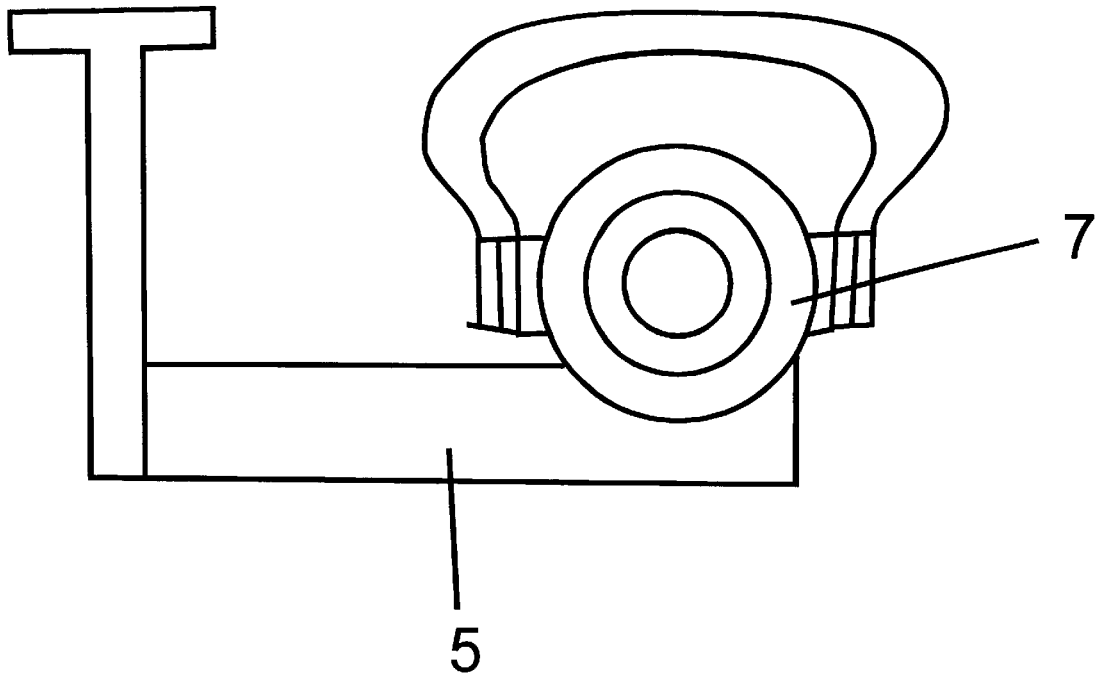
FIG. 4 is a drawing of the nozzle body, with bail handle, and its dimensional relationship to the main horizontal bracket.

FIG. 3 also shows the INTERSENSE IS-600™ mount 2*a* that holds the standard IS-600™ tracking station an appropriate distance away from the nozzle so that proper tracking (no line of sight interference) and no interference with the user occurs. If interference occurs (e.g., the user is left-handed), the bracket design is reversible to allow the tracking station to be on the opposite side of the nozzle. The top cap 4*a* produces a clamping force on the IS-600™ tracking station to keep it in place. FIG. 3 shows an isometric view of how the components 5, 2*a*, and 4*a* fit together and attach to the nozzle 7. FIG. 4 shows a front view of the nozzle 7 and bracket 5 assembly.

Mount for Potentiometer to Measure the Pattern Selector Position

The nozzle pattern selector rotates approximately 180 degrees counter-clockwise relative to the nozzle sleeve, and it is used to set the angle of the nozzle spray pattern. The nozzle sleeve clicks solidly into place relative to the nozzle body, but it can be undone for a "flush" setting, and can rotate about 150 degrees clockwise relative to the nozzle body. Together, this adds up to about 330 degrees of total motion. However, only 180 degrees of it needs to be supported for normal operations (straight stream, narrow angle fog, and wide angle fog). The "flush" setting is not anticipated to be an important training factor, and the nozzle sleeve is required to remain locked for the potentiometer to properly read the pattern selector's position. Requiring the sleeve to be locked allows the design to be simpler.

Figure 5:
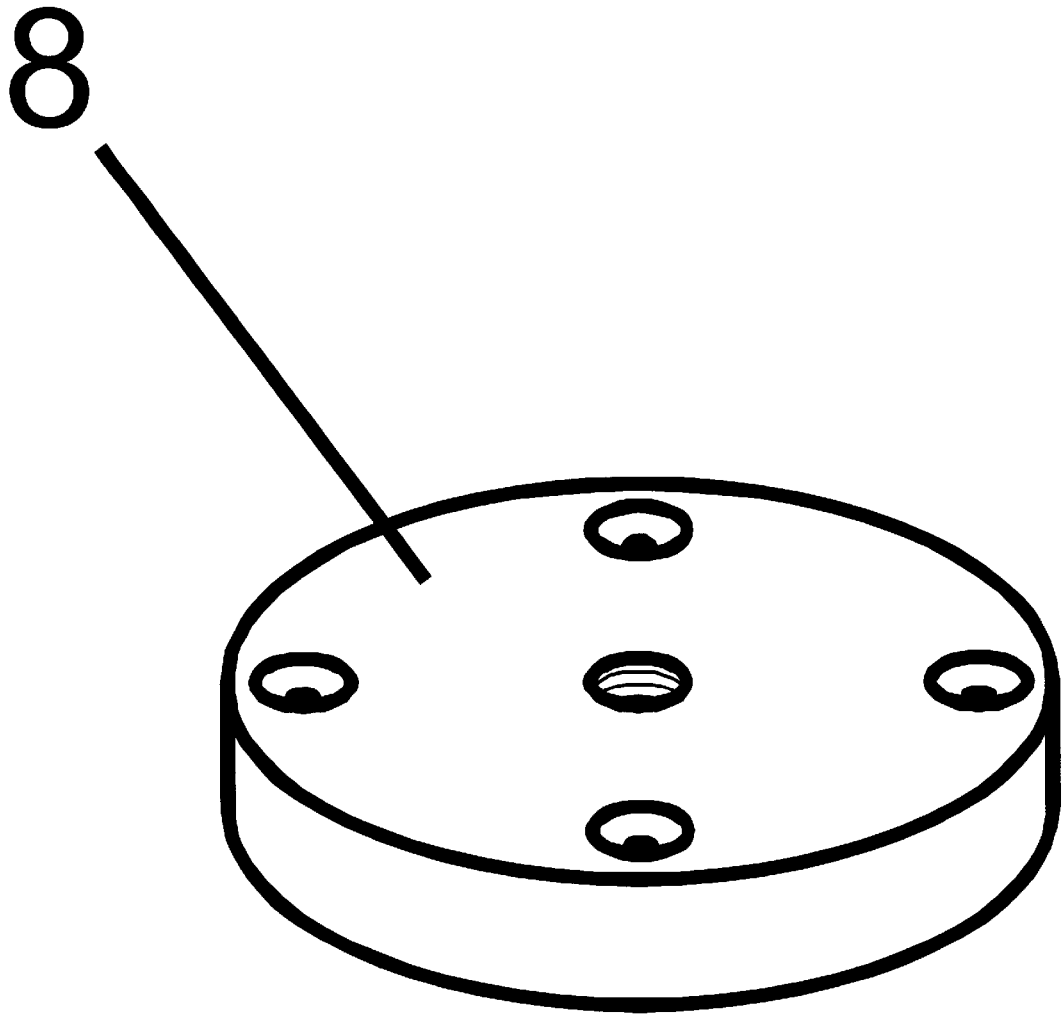
FIG. 5 is a mechanical drawing of the part of the nozzle spray instrumentation components that holds the potentiometer for the nozzle spray instrumentation.
Figure 6:
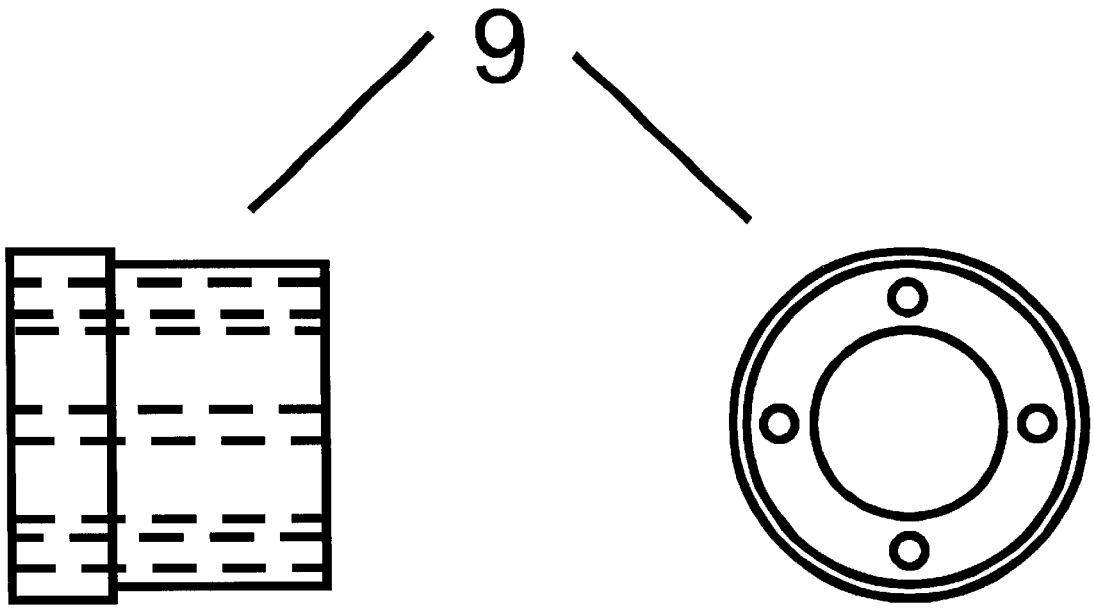
FIG. 6 is a mechanical drawing of the part of the nozzle spray instrumentation components that rigidly clamps to the nozzle body with the part in FIG. 11.
Figure 7:
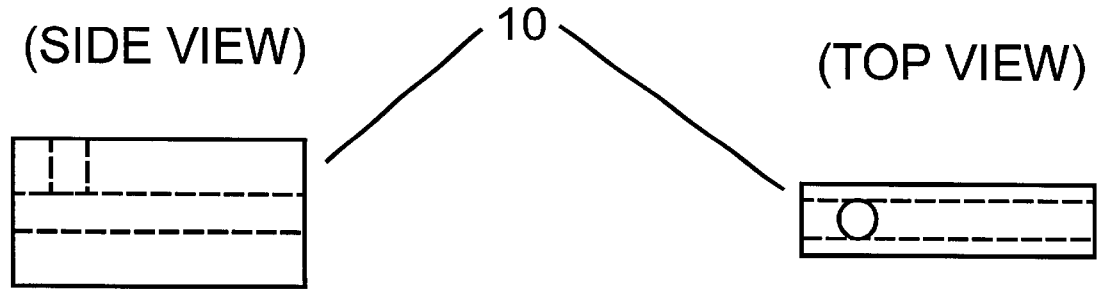
FIG. 7 is a mechanical drawing of a key that attaches to a potentiometer.
Figure 8:
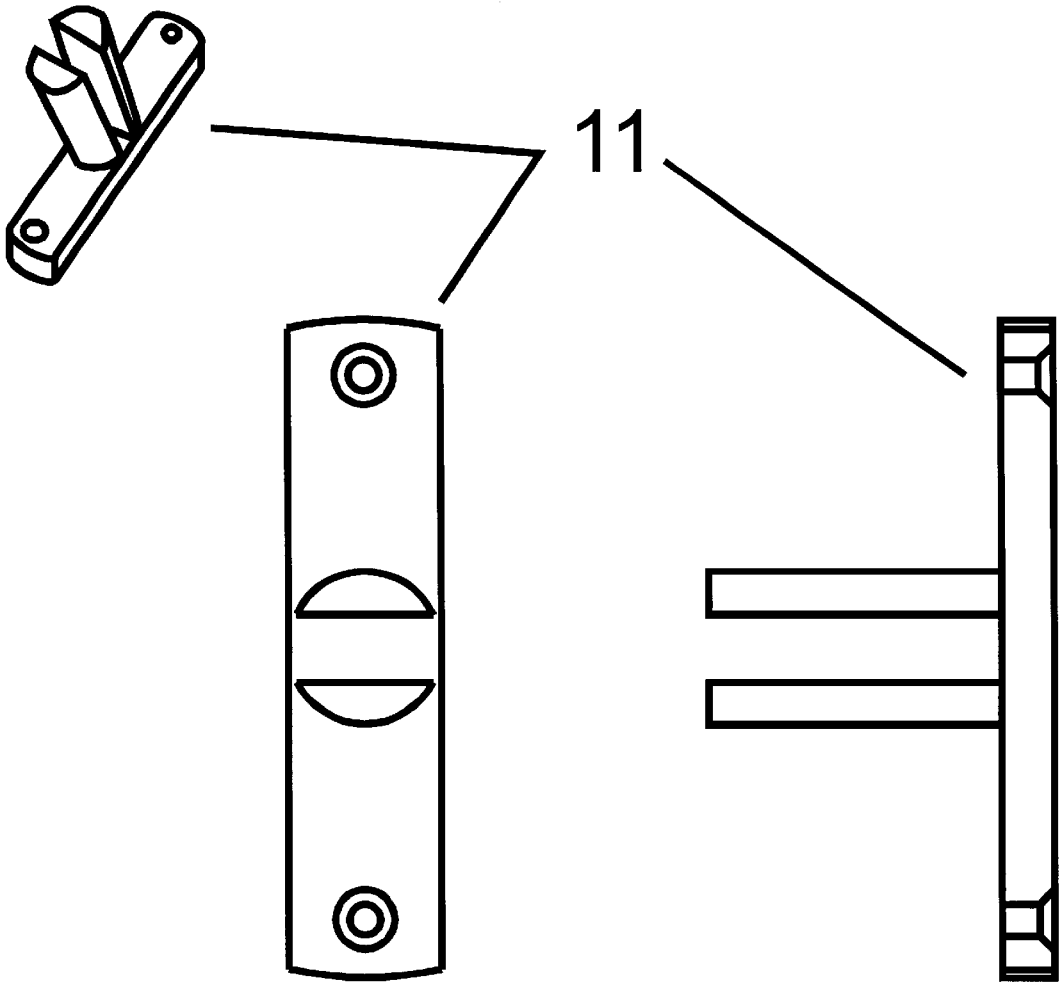
FIG. 8 is a mechanical drawing of the part of the nozzle spray instrumentation components that is attached to the nozzle pattern selector and drives the key attached to a potentiometer.
Figure 9:
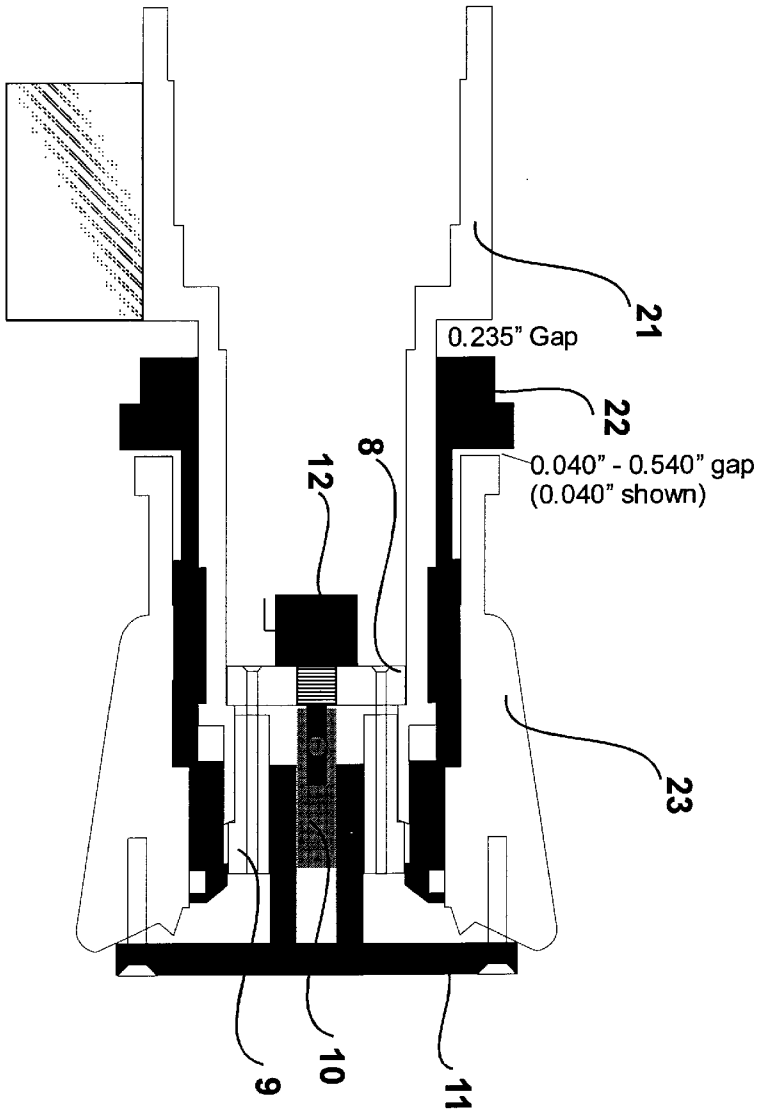
FIG. 9 is an assembly drawing of the components that attach internally to the nozzle to mount a potentiometer inside the body of the nozzle, and the sensing portion of the potentiometer to the moving pattern selector.

FIG. 5 shows a plate 8 that mates to cylinder 9 in FIG. 6. FIG. 7 shows a key 10 that attaches to a potentiometer shaft, and FIG. 8 shows a part 11 with a slot that fits over the key 10 and rotates the potentiometer shaft. FIG. 9 shows an assembly drawing of these parts, illustrating how they rotate the shaft of the potentiometer 12 in concert with the pattern selector 23 to measure the rotation of the pattern selector 23. Pieces 8 and 9 fit inside the nozzle barrel 21 and remain fixed in place by clamping down on a shelf inside nozzle barrel. There is a gap between the two pieces to allow the screws to generate a clamping force. Potentiometer 12 screws into plate 8, and the rotating portion of the potentiometer protrudes into the cylinder 9. Part 11 screws into the rubber portion of the pattern selector 23, fits over key 10, and rotates the shaft of potentiometer 12 when the pattern selector is turned.

The potentiometer 12 has a range of rotation of only 295 degrees. Therefore, even though 10 has a place for a setscrew, it was not used in the preferred embodiment because it would damage the part if the user ever turned the nozzle sleeve. It was noticed that the key held very tightly to the shaft of the potentiometer, and the friction between the shaft and key was sufficient in measuring the motion of the pattern selector 23 without slipping.

Mount for Potentiometer to Measure the Bail Handle Position

The nozzle bail handle (25 in FIG. 10) rotates approximately 100 degrees, and the shaft of the potentiometer (the same model as chosen for the nozzle pattern selector) is designed to rotate about the same axis as the bail handle. Part 13 and part 14 in FIG. 10 form a case that holds a potentiometer 24 and RJ-45 connector 17 and attaches to the main horizontal bracket 5. Potentiometer 24 rigidly attaches to key 15, which fits into keyway 16. Keyway 16 is attached to bail handle 25 with a bolt into a tapped hole in 25. Washers or nuts may be used for spacing the keyway 16 away from the bail handle 25. FIG. 11 shows front and top views of the assembly from FIG. 10.

Figure 10:
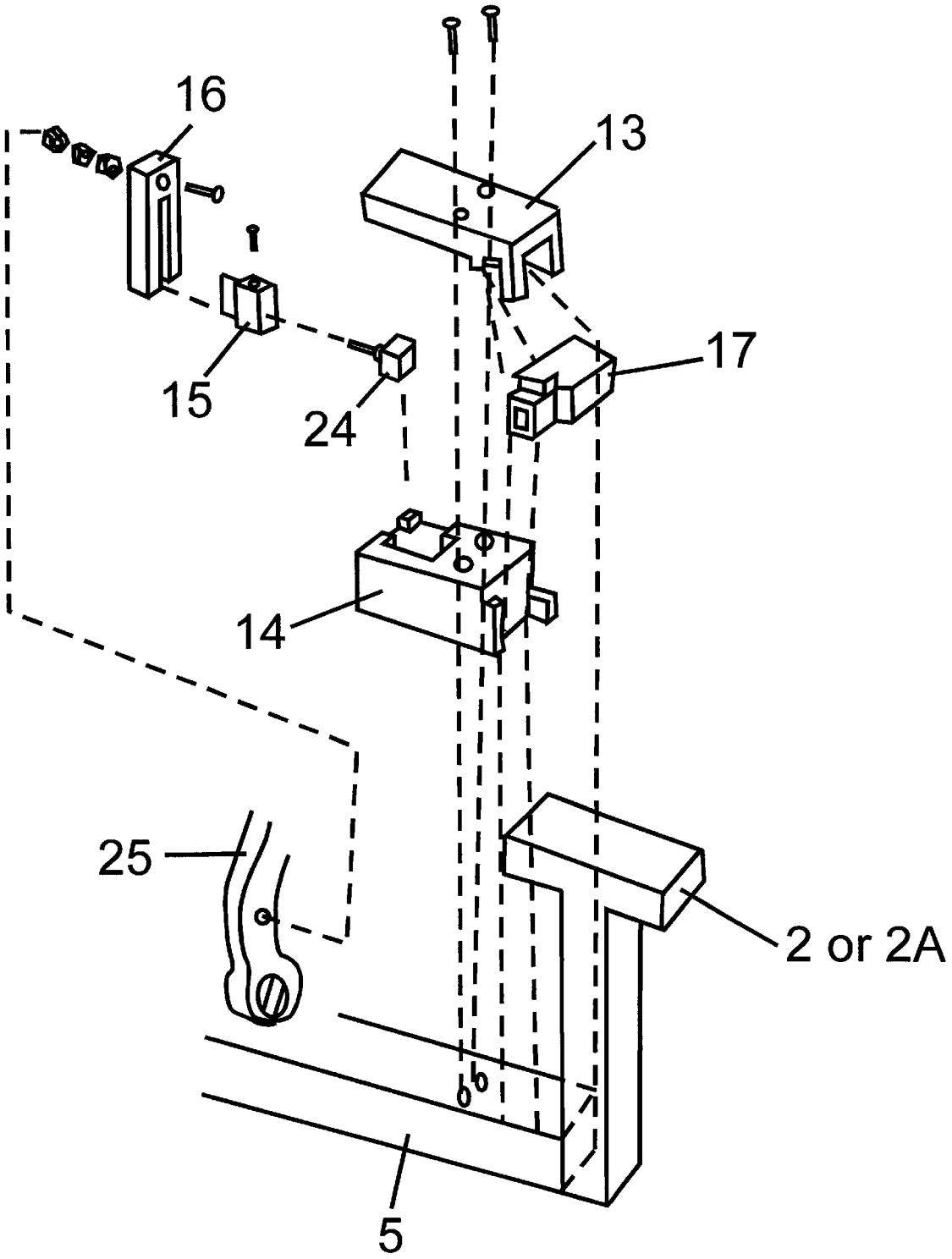
FIG. 10 is an exploded assembly drawing of all bail handle instrumentation components.
Figure 11:
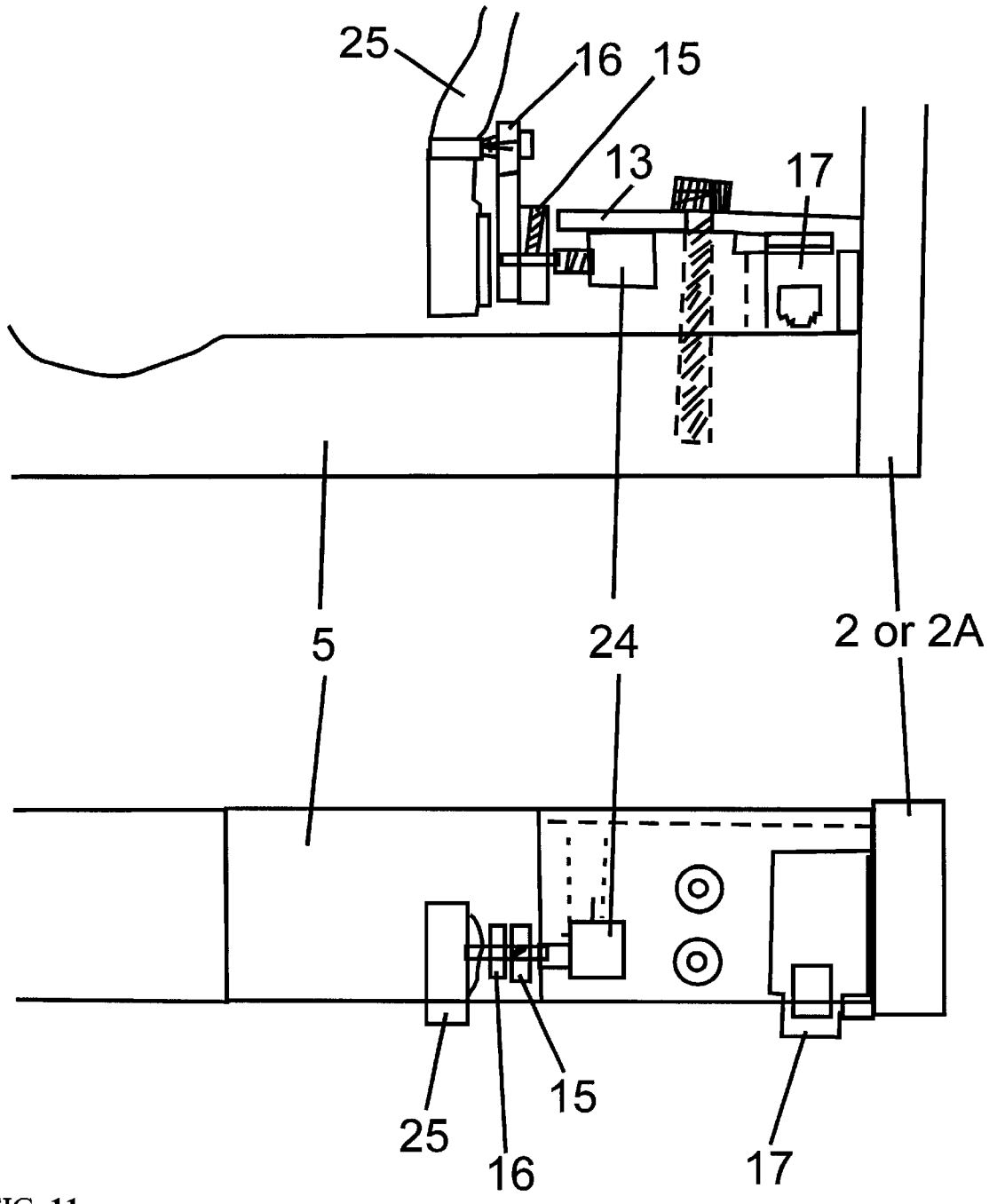
FIG. 11 is an assembly drawing of the bail handle instrumentation components.

Even though the potentiometer is designed to be centered, a key 15 and keyway 16 in FIG. 10 were designed to allow for a great deal of misalignment of the parts, thereby reducing the risk of damaging the sensitive potentiometer. The key 15 fits in the keyway 16 with a tight, yet sliding fit, allowing movement in all 6 degrees of freedom to compensate for a lack of perfect machining and part placement, and to allow for some slop in the axis of rotation of the nozzle bail handle. A gap between the body of the key 15 and the keyway 16 was introduced so that axial motion (along the potentiometer shaft) in either direction won't damage the potentiometer. The net effect is that the potentiometer is rigidly mounted, but the coupling effectively connects the motion of the bail handle to the shaft of the potentiometer with essentially no play and without putting any significant stress on the bearings of the potentiometer.

An 8-pin RJ-45 connector 17 in FIG. 10 is held on five sides by parts 13 and 14. The INTERSENSE bracket vertical mount 2 or 2*a* and the main horizontal mount 5 combine to hold the RJ-45 connector on the remaining side. The bottom surface of the connector was ground flat to make it sit better. The RJ-45 connector and an associated 8-pin category 5 network cable were used because they could easily be obtained in black.

Electrical and Analog-to-Digital Aspects of the Invention

Because only four signals are needed, LLGND (low level ground), +10 V (for power), AI0 (Analog In 0), and AI1 (Analog In 1), a four-pin telephone (RJ-11 cable) system could have been used instead of an RJ-45 cable. The components for such a system are known to exist, but since 8-pin components were readily available, those were used. A similar design using four-pin telephone connections is considered for use in future revisions of the invention.

Figure 12:
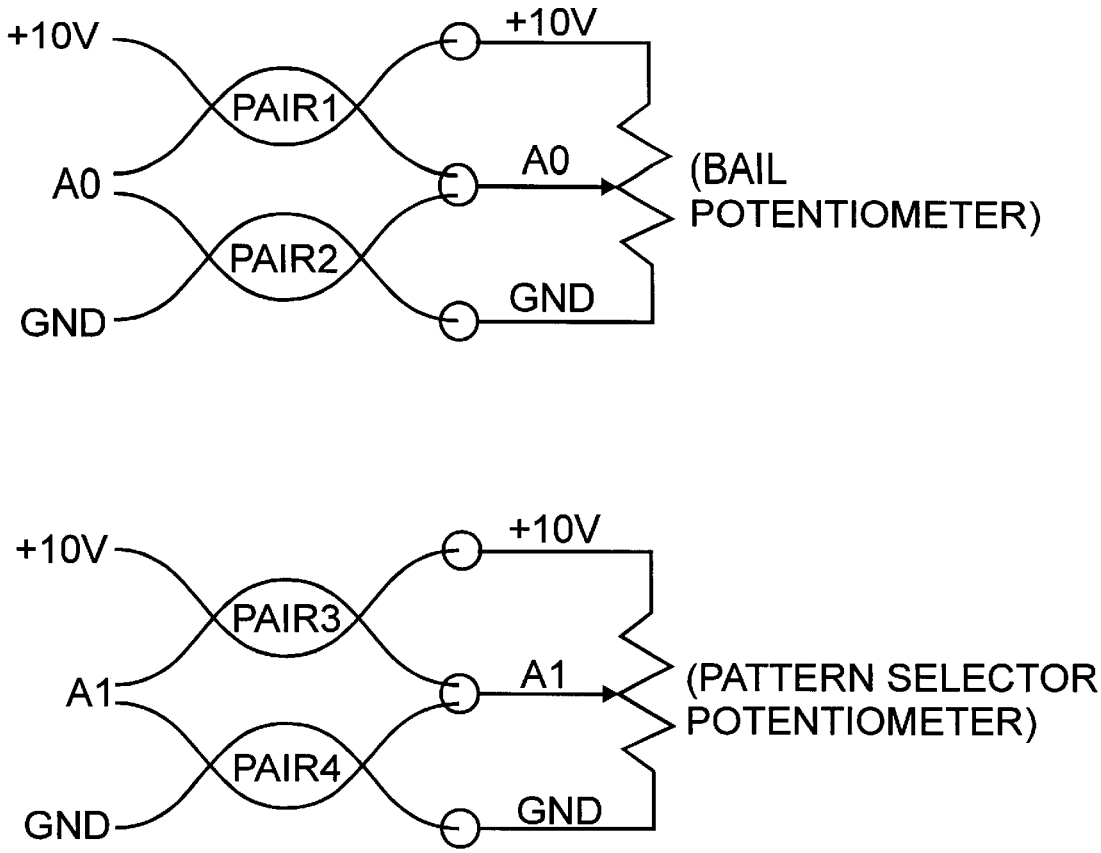
FIG. 12 is a wiring diagram from the analog-to-digital converter, wire/signal pairings through the twisted pair ethernet-type cable, and the anticipated connections to the two potentiometers connected to the RJ-45 connector.

In making the connection from the analog-to-digital converter, there were four signals to deal with (ground, +10 volts, and the two readings from the potentiometers, signal 0 and signal 1), and 8 wires to accomplish the task. To make the best use of the wires, using the fact that a twisted-pair cable has pairs of wires twisted together to reduce electromagnetic noise and interference, a wiring pattern was chosen (FIG. 12) which made logical pairings between the signal connections and power/ground wires.

There are two main types of wiring layouts of RJ-45 connectors. Both were used in the invention. One RJ-45 connector is attached to a box made to connect to an analog-to-digital converter, and one is attached to the nozzle bracket.

Potentiometers 12 and 24 (Model #93F9870, Spectrol Electronics Corp., 4051 Greystone Drive, Ontario, Calif. 91761, U.S.A) were chosen based on a few factors: (1) small size, (2) square shape to allow easy mounting, (3) range of motion, and (4) resistance value. The resistance value of ten kilo-ohms was chosen because the ten volt power supply on the analog-to-digital converter can supply two milliamps. The closer the load is set to the maximum current load, the better, since lower resistances produce less noise. With the two potentiometers, the load is two milliamps.

The analog-to-digital converter we chose for our implementation, the COMPUTERBOARDS PPIO-8™, (Measurement Computing Corp., formerly ComputerBoards, 16 Commerce Boulevard, Middleboro, Mass. 02346, U.S.A) is an inexpensive parallel port-based unit. It takes power from the PC, and sends its information to the PC via the parallel port. A software development kit is available which allows input from the unit to be used in applications written in a number of programming languages.

Alternate Embodiments of the Invention

Figure 13:
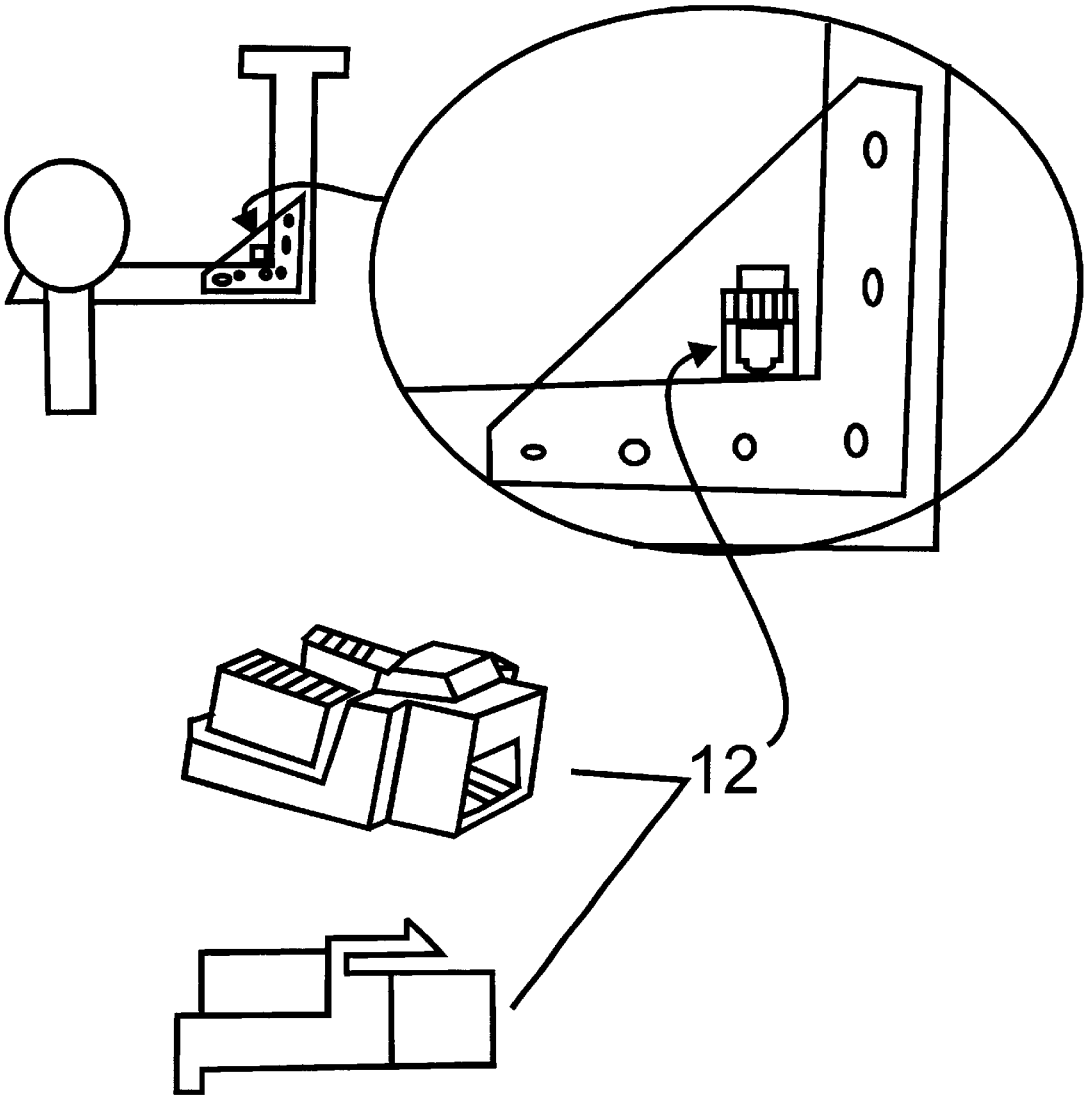
FIG. 13 is a drawing of an alternative method to very simply mount the RJ-45 connector.
Figure 14:
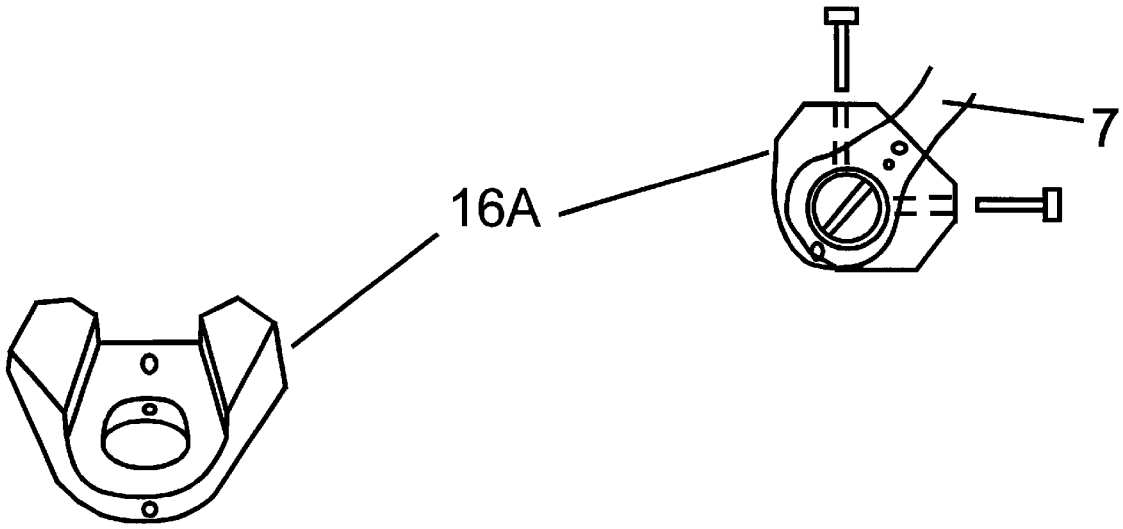
FIG. 14 is a drawing of an alternative method to connect a potentiometer to a bail handle.
Figure 15:
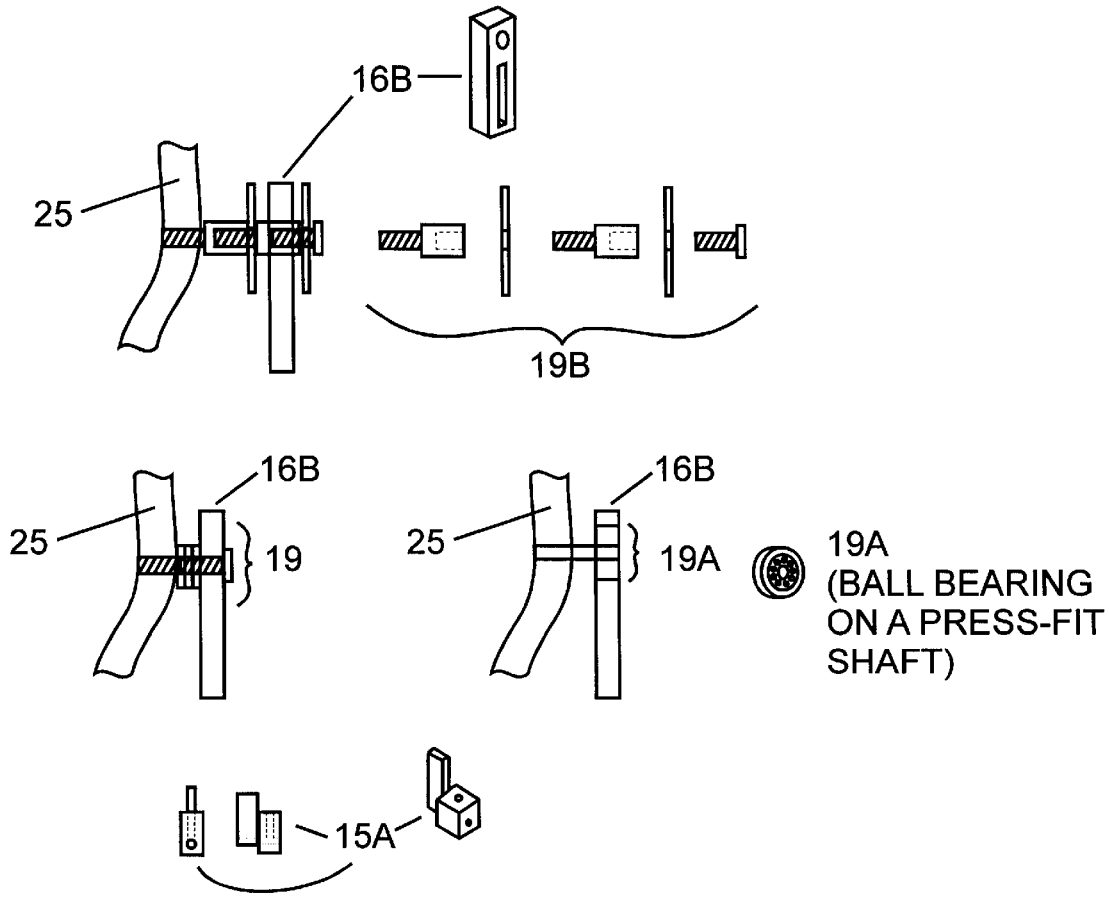
FIG. 15 includes drawings made of alternative designs for connecting the potentiometer to the bail handle.

Several methods were considered before arriving at the preferred embodiment, and those methods are presented in the remaining Figures. FIG. 13 shows an alternate method of mounting the RJ-45 connector 12 with a single mounting plate. This design is simpler to make and install than the preferred embodiment, but is less durable, so it was not chosen for this implementation. FIG. 14 shows an alternative part 16*a* that could be used for a nondestructive or destructive coupling of potentiometer 24 to bail handle 25. Whether the design in FIG. 14 is nondestructive or destructive depends on whether the screws penetrate the bail handle or simply clamp onto it. FIG. 15 shows an alternate embodiment of a keyway 16*b* with a closed bottom. Additionally, FIG. 15 shows three methods of attaching keyway 16 or 16*b* to the bail handle 25, including bolt and nuts 19 (the preferred embodiment), press-fit bearing and shaft 19*a*, and pivot 19*b*. FIG. 15 also shows an alternate potentiometer-to-keyway connector 15*a*.

Figure 16:
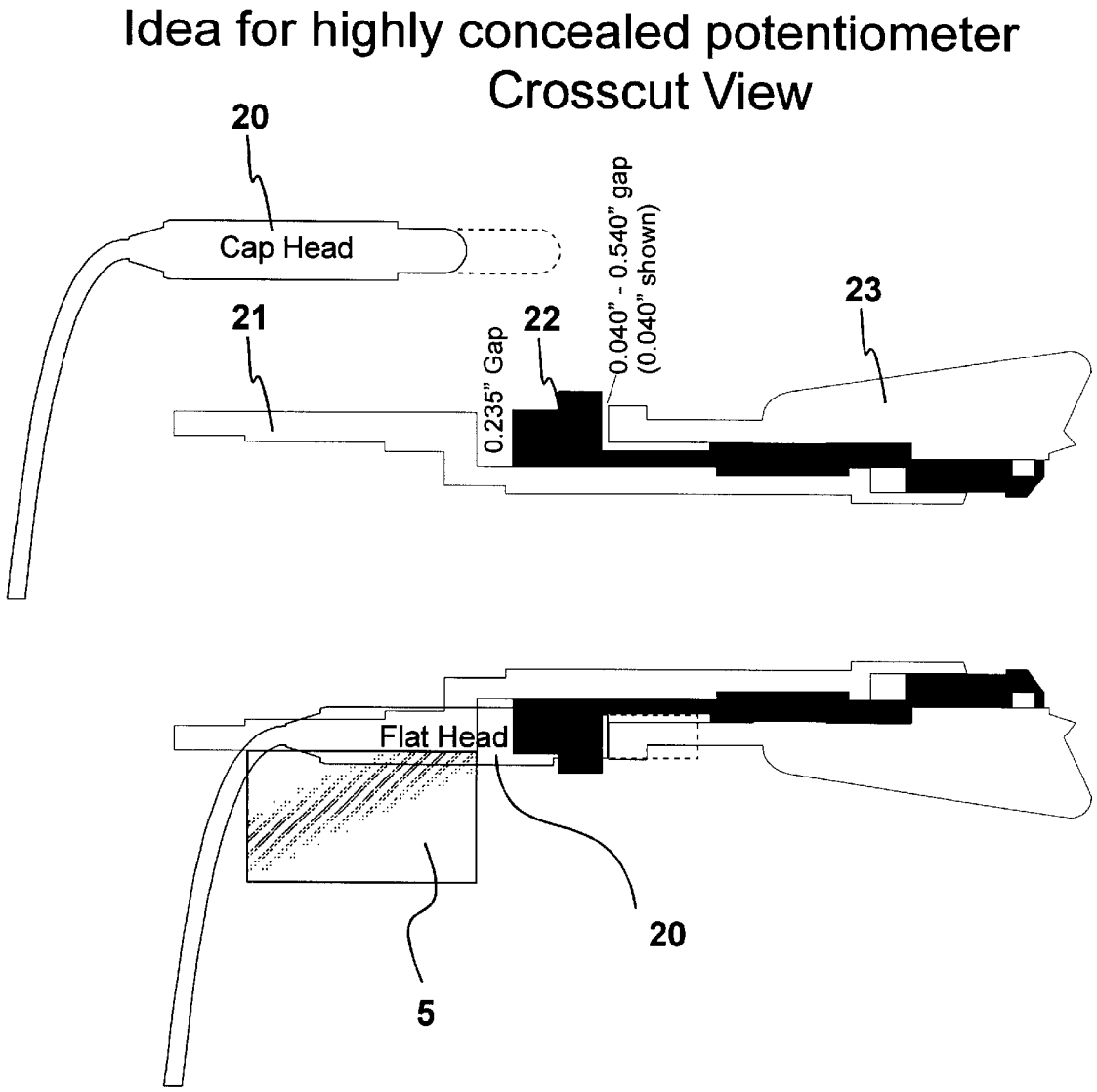
FIG. 16 and FIG. 17 are drawings of a design to use the linear potentiometer to sense the position of the nozzle pattern selector. In this design, the linear potentiometer is concealed inside a machined recess in the nozzle.
Figure 17:
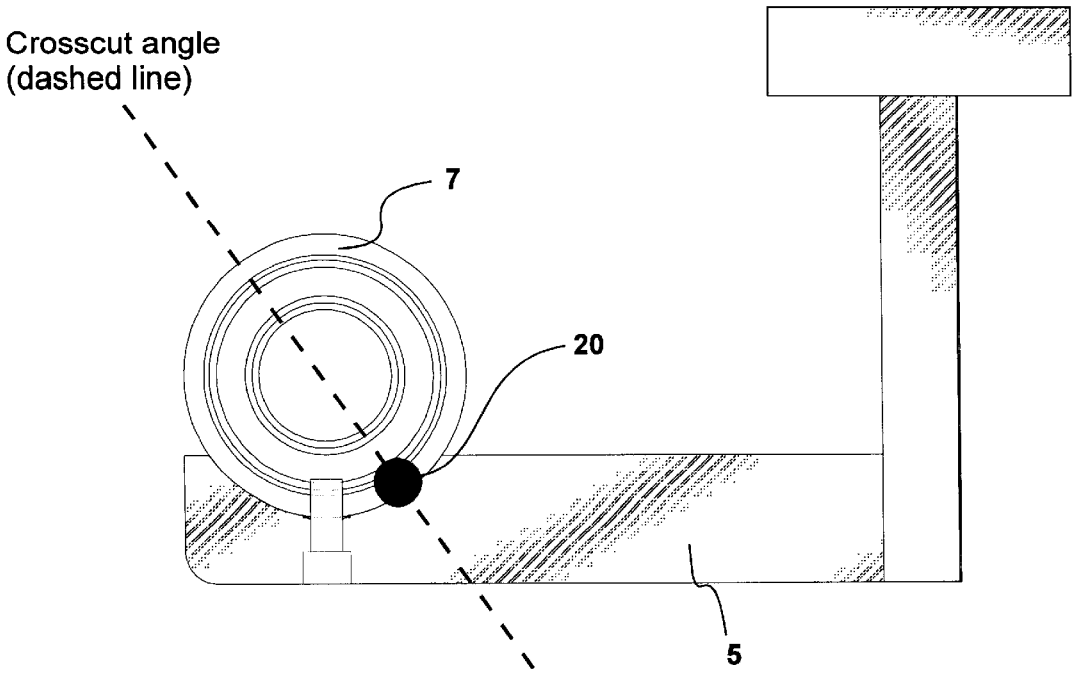
Figure 18:
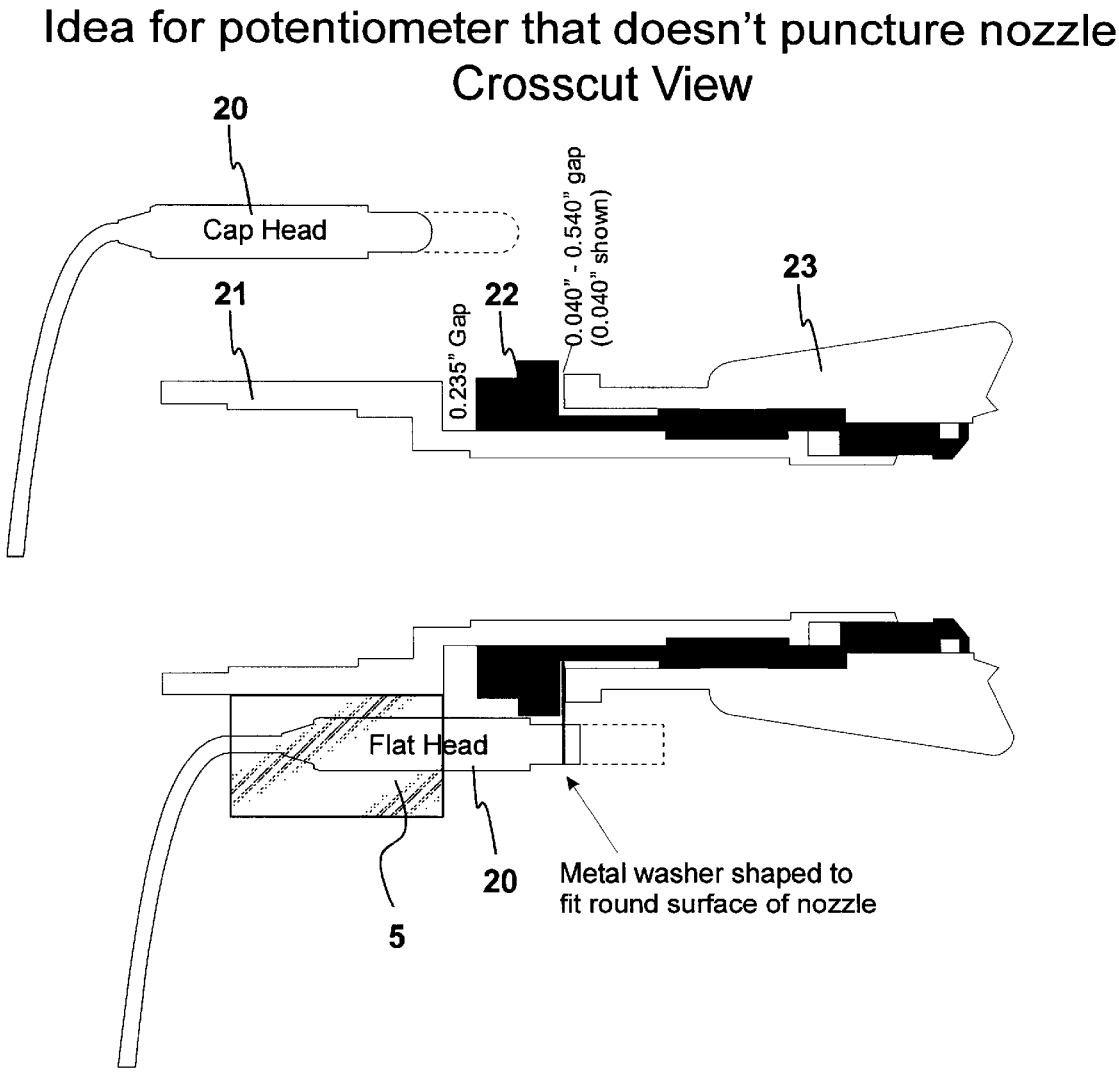
FIG. 18 and FIG. 19 are drawings of an alternative idea to use the linear potentiometer to sense the position of the nozzle pattern selector. In this design, the linear potentiometer does not puncture the nozzle.
Figure 19:
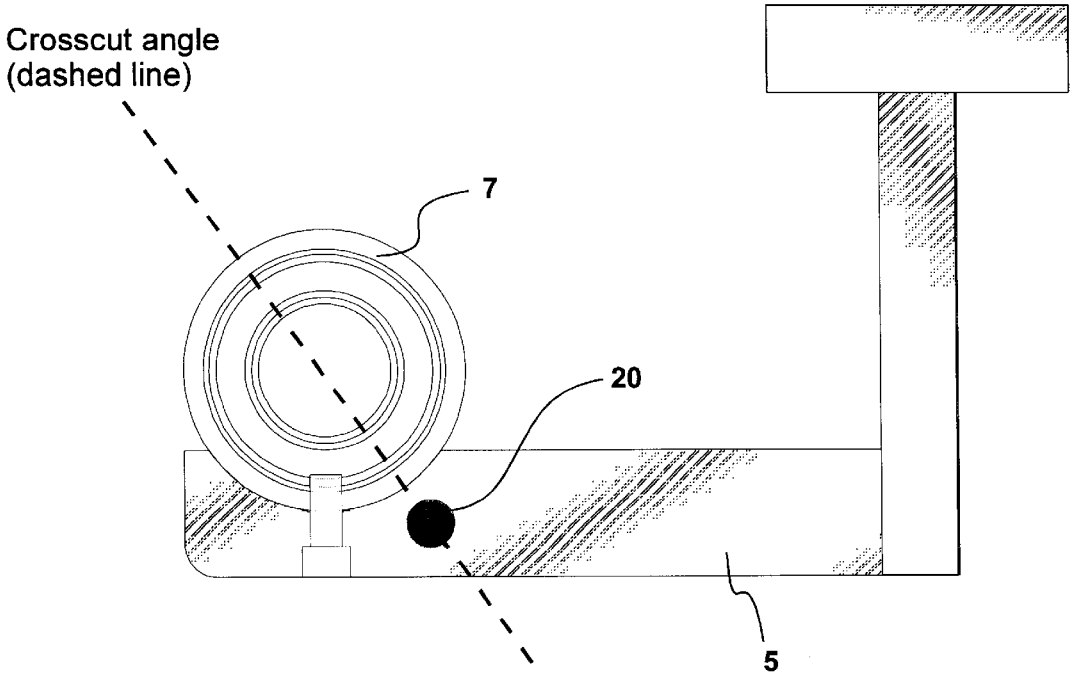

A spring-loaded linear potentiometer 20 in FIG. 16 has also been considered to measure pattern selector angle instead of rotational potentiometer 12. FIG. 16 illustrates that a cap head or flat head linear potentiometer can fit into a hole drilled in the nozzle body 21 and 22. The potentiometer 20 can be compressed as the pattern selector 23 is turned. FIG. 17 presents another view of this alternative. FIG. 18 and FIG. 19 illustrate an alternate mounting location for potentiometer 20 that does not require a hole to be drilled in 21 and 22.

Although specific features of the invention are shown in the drawing and not others, this is for convenience only, as each feature may be combined with any or all of the other features in accordance with the invention.

Other embodiments that will occur to those skilled in the art are within the following claims:

What is claimed is:

1. An instrumented firefighter's nozzle that reads and sends information to a computer, used in virtual or augmented reality firefighter training, for displaying to the user a computer-generated graphical representation of a stream of extinguishing agent aligned with the actual nozzle in a manner consistent with its operation, comprising:

a hand-held firefighter's nozzle with one or more flow regulating devices that control the application rate of extinguishing agent;

one or more sensors for measuring the setting of the flow regulating devices; and position and orientation tracking equipment, attached to the nozzle, for accomplishing real time six degree-of-freedom tracking of the position and orientation of the nozzle.

2. The firefighter's nozzle of claim 1 in which one or more of the sensors are potentiometers.

3. The firefighter's nozzle of claim 2 further including a key and keyway for attaching the potentiometer to the flow regulating device.

4. The firefighter's nozzle of claim 1 further including wiring connected to the sensors and the position and orientation tracking equipment, and a protective enclosure for the sensors and wiring to increase ruggedness.

5. The firefighter's nozzle of claim 1 further including a standard 8-wire cable and an analog-to-digital converter, wherein some of the wires in the cable are used to transmit the electrical signals from the sensors to the analog-to-digital converter, and the remainder of the wires in the cable are connected to the tracking equipment.

6. The firefighter's nozzle of claim 1 further including an analog-to-digital converter and a standard 4-wire cable, wherein the wire is used to transmit the electrical signals from the sensors to the analog-to-digital converter.

7. The firefighter's nozzle of claim 1 in which the equipment that can perform real time tracking is an InterSense IS-600™ device.

8. The firefighter's nozzle of claim 1 in which the equipment that can perform real time tracking is an InterSense IS-900™ device.

9. The firefighter's nozzle of claim 1 in which the sensors are positioned in such a way at to be largely non-intrusive to the user and resistant to damage by the user.

10. The firefighter's nozzle of claim 1 further including wires connecting the sensors to an analog-to-digital converter and wires connecting tracking equipment to the devices that interface with the tracking equipment and a standard firefighter nozzle hose, wherein all of the wires enter inside the end of the hose attached to the nozzle and run through the length of the hose and exit the other end of the hose to then connect the wires to the corresponding equipment.

11. The firefighter's nozzle of claim 1 further comprising a nozzle pattern selector that controls the angular width of the extinguishing agent as it exits the nozzle.

12. The firefighter's nozzle of claim 11 further comprising one or more sensors for measurement of the setting of the nozzle pattern selector.

13. The firefighter's nozzle of claim 12 in which a sensor comprises a linear potentiometer that is used to measure the position of the nozzle pattern selector.

14. The firefighter's nozzle of claim 12 in which the attached tracking equipment does not reduce the functionality of the sensors that measure the positions of the pattern selector and flow regulating device.

15. The firefighter's nozzle of claim 12 in which measurements of the setting of the nozzle pattern selector are sent from the sensors to a computer.

16. The firefighter's nozzle of claim 1 in which measurements of the setting of the flow regulating device are sent from the sensors to a computer.

* * * * *